US007645015B2

(12) United States Patent
McConica

(10) Patent No.: US 7,645,015 B2
(45) Date of Patent: Jan. 12, 2010

(54) DETERMINING DROP WEIGHT

(75) Inventor: Charles H. McConica, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 454 days.

(21) Appl. No.: 11/735,100

(22) Filed: Apr. 13, 2007

(65) Prior Publication Data

US 2008/0252678 A1 Oct. 16, 2008

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS

| | | | | |
|---|---|---|---|---|
| 6,378,976 | B1 * | 4/2002 | Byers et al. | 347/19 |
| 6,572,213 | B2 * | 6/2003 | Valero | 347/19 |
| 2007/0279466 | A1 * | 12/2007 | Kinas | 347/100 |

* cited by examiner

*Primary Examiner*—Julian D Huffman

(57) ABSTRACT

Embodiments of determining drop weight are disclosed.

18 Claims, 4 Drawing Sheets

DETERMINING DROP WEIGHT

BACKGROUND

Modern printing devices, such as inkjet printers, often provide estimates to users as to how many pages can be printed with the printing device. Determining these estimates with a desired degree of accuracy using information pertaining to the weight of ink droplets ("drop weight") ejected by inkjet pens of the printing device can be difficult.

BRIEF DESCRIPTION OF THE DRAWINGS

The disclosed systems and methods can be better understood with reference to the following drawings. The components in the drawings are not necessarily to scale.

DETAILED DESCRIPTION

As described above, drop weights stored by printing devices and used in estimating the number of pages that can be printed can be inaccurate relative to the actual weight of ink droplets ejected by the inkjet pens of the printing devices. Such inaccuracy leads to inaccurate estimates of the number of pages that can be printed by the printing devices. As described in the following, however, increased accuracy as to the number of pages that can be printed can be achieved by intermittently measuring actual drop weights with the printing device. With such operation, the effects of manufacturing variation and the variation of inkjet pen characteristics over time can taken into account, thereby reducing or removing a significant source of estimate inaccuracy. In some embodiments, one or more of the inks provided within the printing device contain a marker that can be detected by the printing device and used to determine the weight of ink droplets ejected by one or more of the printing device's inkjet pens.

Disclosed herein are embodiments of systems and methods for estimating expected delivered pages relative to actual drop weight measured by a printing device. Although particular embodiments are disclosed, those embodiments are provided for purposes of example only to facilitate description of the disclosed systems and methods. Therefore, the disclosed embodiments are not intended to limit the scope of this disclosure.

Figure 1:
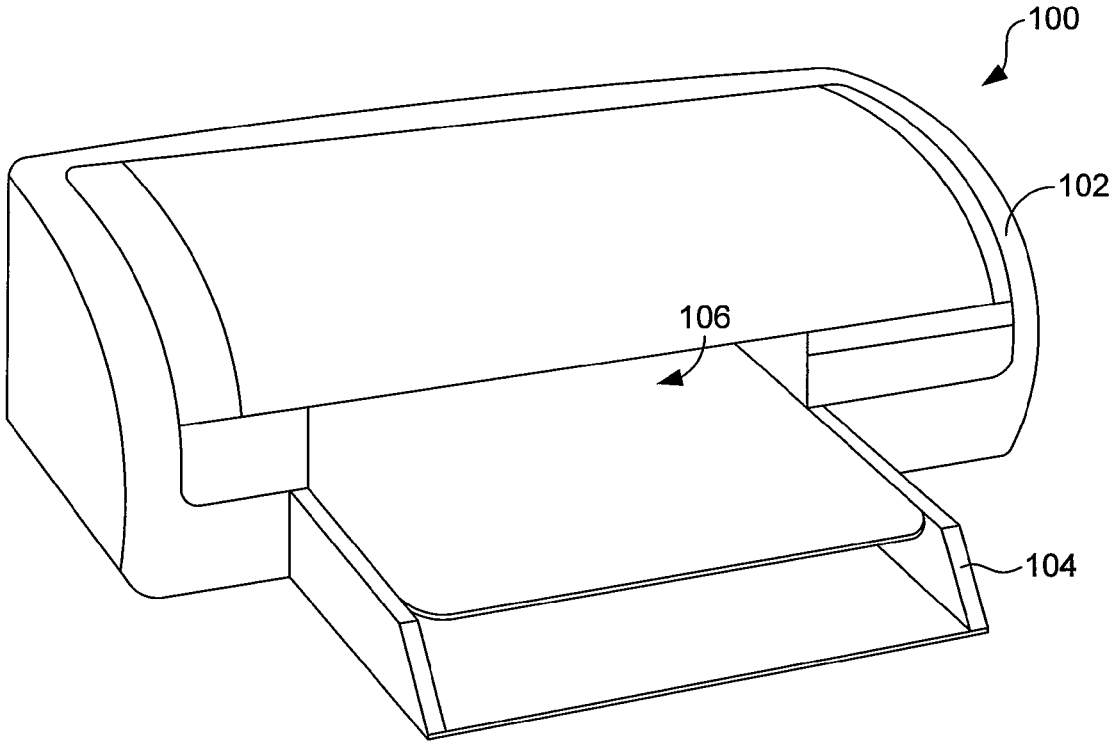
FIG. 1 is a perspective view of an embodiment of a printing device configured to measure inkjet pen drop weight.

Referring now in more detail to the drawings, in which like numerals indicate corresponding parts throughout the several views, FIG. 1 illustrates an example printing device 100. By way of example, the printing device 100 comprises an inkjet printer. Although a "printer" has been specifically mentioned, it is noted that the printing device 100 need not be limited to printing alone. For example, in some embodiments, the printing device 100 can provide further functionalities such as copying, faxing, and emailing. In such a case, the printing device 100 may be described as a multi-functional printing device.

As indicated in FIG. 1, the printing device 100 comprises an outer housing 102 that contains the various internal components of the printing device. As described below, those components can comprise a print mechanism that includes one or more inkjet pens configured to eject droplets of ink on a suitable print medium, such as paper. The printing device 100 further includes a media tray 104 that can be used to feed media into a print path of the printing device. Although only one media tray 104 is illustrated in FIG. 1, the printing device 100 can alternatively comprise multiple media trays. As further indicated in FIG. 1, the printing device 100 further comprises an output area 106 at which printed media can be output from the printing device.

Figure 2:
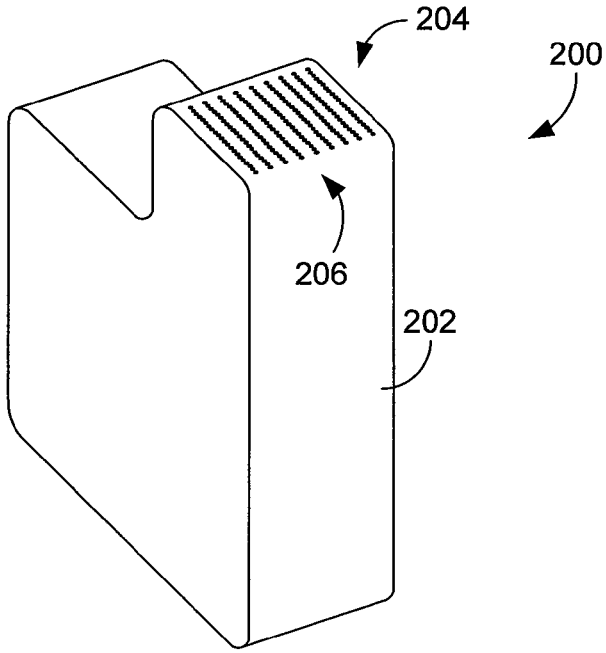
FIG. 2 is a perspective view of an embodiment of an inkjet pen of the printing device of FIG. 1.

FIG. 2 illustrates an example inkjet pen 200 that can be used within the printing device 100. In some embodiments, the printing device 100 comprises several such inkjet pens 200, each containing a different color. For instance, the printing device 100 may have separate inkjet pens for cyan, magenta, yellow, and black inks.

The inkjet pen 200 comprises an outer housing 202 that contains a known initial quantity of ink. Provided on an end of the inkjet pen 200 is a printhead 204 that is used to selectively eject droplets of ink onto print media. As is schematically depicted in FIG. 2, the printhead 204 comprises a plurality of nozzles 206 from which the ink droplets are emitted. As is further depicted in FIG. 2, the nozzles 206 can be arranged in rows and/or columns. In some embodiments, the nozzles 206 eject ink droplets when adjacent heater resistors (not shown) contained within the printhead 204 are activated to heat the ink.

The ink contained within one or more of the inkjet pens 200 contains a light absorption material, such as a marker dye, that can be detected with a sensing device (FIG. 3) of the printing device 100. The light absorption material is outside of the human visible spectrum so as to be substantially invisible to the user. In some embodiments, the light absorption material absorbs infrared (IR) light, such as near-IR (NIR) light, and therefore can be detected when illuminated by an IR light source, such as an NIR light source. In some embodiments, the light absorption material absorbs light having a wavelength in the range of approximately 750 nanometers (nm) to approximately 950 nm. Examples of suitable NIR dyes are explicitly identified in U.S. patent application Ser. Nos. 11/445,807 and 11/445,519, both filed Jun. 6, 2006, both of which are hereby incorporated by reference into the present disclosure. In other embodiments, the light absorption material may absorb other wavelengths of light that are not visible to humans (i.e., invisible light), such as ultraviolet (UV) light.

The amount of light absorption material that is added to the printing device inks is relatively small so as to not significantly affect the appearance of the ink when deposited on the selected print media or the performance of the inkjet pen in which the ink is contained. By way of example, inks may comprise from approximately 0.01% to approximately 0.5% by weight of the light absorption material. Notably, the amount of light absorption material that is added to each ink of multi-color printing devices may vary in accordance with the inherent light absorption characteristics of the inks. One goal of this designed variation in the amount of light absorption material is to achieve the same response of a sensing device (described below) for the same drop weight of each color of ink. Another goal is to have a known relationship between the responses of the sensing device for the same drop weight for each color of ink. Lesser amounts of light absorption material may be necessary for black and cyan ink than for yellow and magenta ink. Regardless, in at least some embodiments, the amount of light absorption material contained in each of the inks is substantially constant over the life of each ink.

Figure 3:
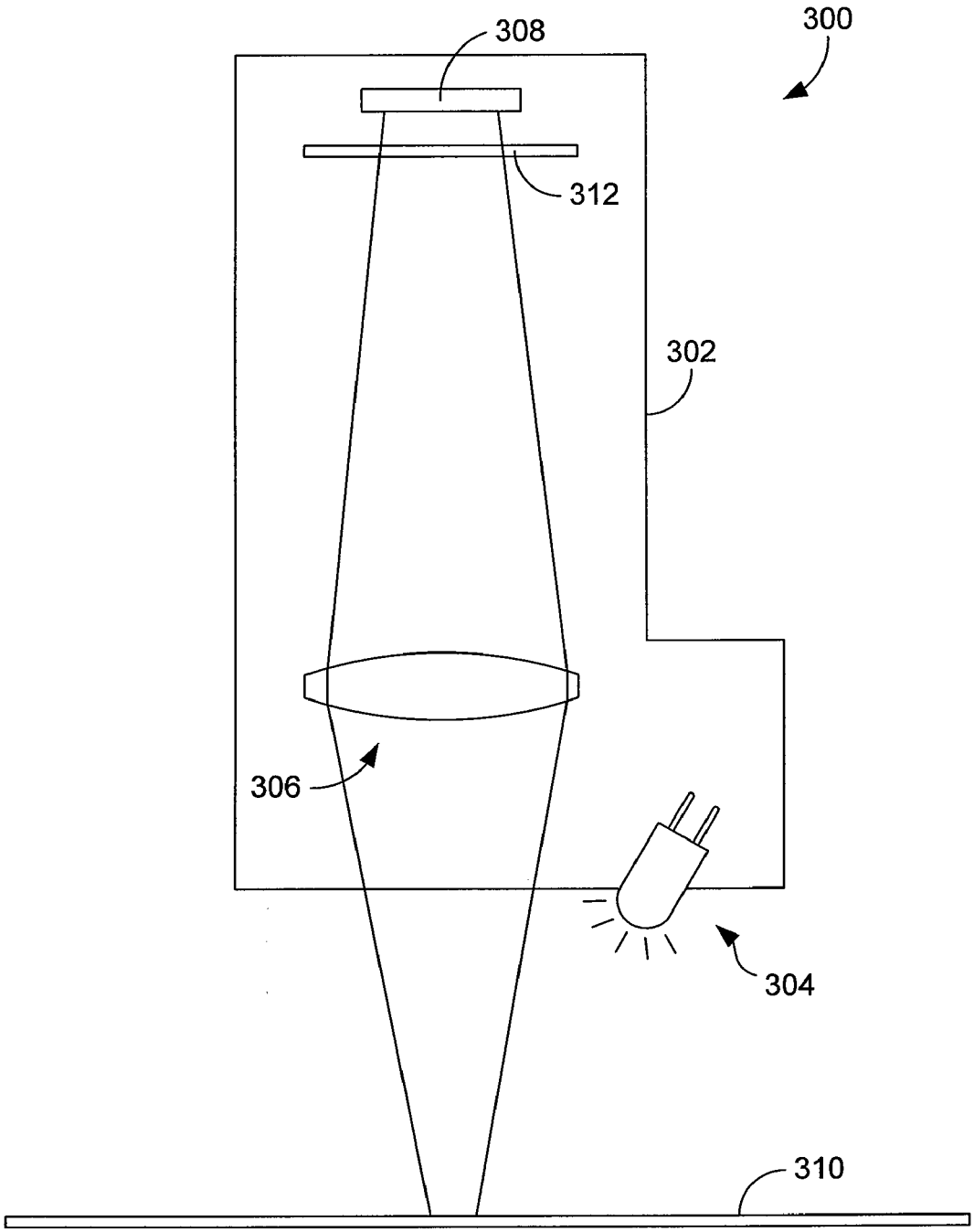
FIG. 3 is schematic view of an embodiment of a sensing device used in the printing device of FIG. 1.

FIG. 3 schematically illustrates a further component of the printing device 100. In particular, FIG. 3 illustrates a sensing device 300 that is positioned adjacent the inkjet pens 200 of the printing device 100. In some embodiments, the sensing device 300 is mounted to an internal carriage (not shown) of the printing device 100 that supports the inkjet pens 200. As indicated in FIG. 3, the sensing device 300 generally comprises a housing 302 that contains or supports a light source 304, an optical system 306, and a photodetector 308. The light source 304 can emit invisible light, such as NIR light, downward toward print media 310 when the media is positioned along the print path of the printing device 100. In some embodiments, the light source 304 comprises one or more NIR light-emitting diodes (LEDs).

The light emitted by the light source 304 is reflected by the print media 310 to the optical system 306, which directs the reflected light onto the photodetector 308 with one or more lenses that focus that light on the photodetector. The photodetector 308 is configured to detect intensity of the invisible light reflected by the print media 310. By way of example, the photodetector 308 comprises a phototransistor. In some embodiments, a filter 312 is provided between the optical system 306 and the photodetector 308 to filter out light radiation that may interfere with detection of light reflected by the print media 310.

Figure 4:
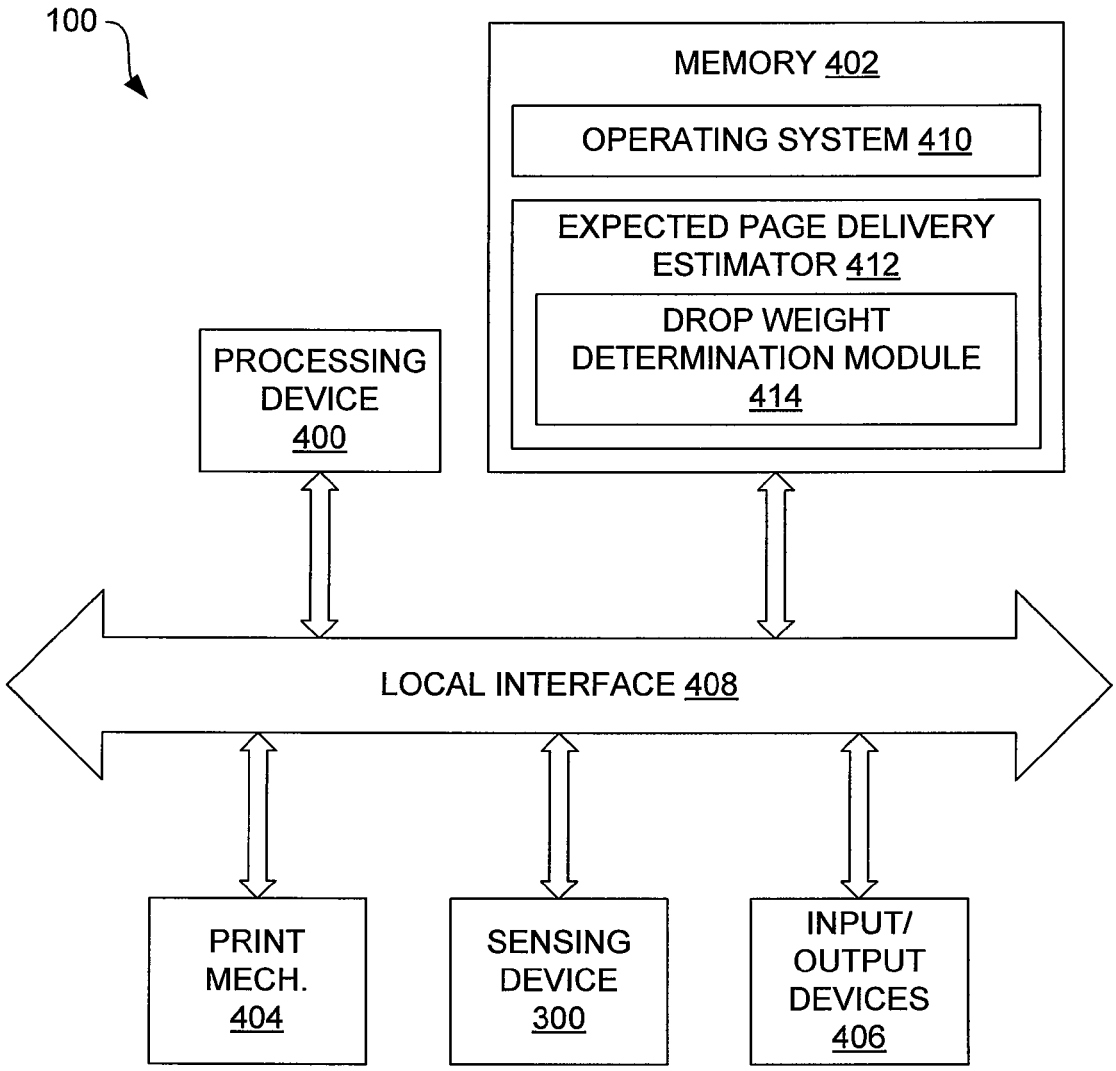
FIG. 4 is a block diagram of an embodiment of the architecture for the printing device of FIG. 1.

FIG. 4 is a block diagram illustrating an example architecture for the printing device 100 shown in FIG. 1. As is indicated in FIG. 4, the printing device 100 comprises a processing device 400, memory 402, a print mechanism 404, the sensing device 300, and at least one input-output (I/O) device 406. Each of those components is connected to a local interface 408.

The processing device 400 is adapted to execute commands stored in memory 402 and can comprise a general-purpose processor, a microprocessor, one or more application-specific integrated circuits (ASICs), a plurality of suitably configured digital logic gates, and other well known electrical configurations comprised of discrete elements both individually and in various combinations to coordinate the overall operation of the printing device 100. The memory 402 comprises any one or a combination of volatile memory elements (e.g., random access memory (RAM)) and nonvolatile memory elements (e.g., read-only memory (ROM), Flash memory, hard disk, etc.).

The print mechanism 404 includes the components that are used to perform printing, including the inkjet pens 200. The one or more I/O devices 406 facilitate communications between the printing device 100 and other devices, and therefore may enable connection of the printing device to a host computer and/or a network.

The memory 402 includes various programs including an operating system 410 and an expected page delivery estimator 412. The operating system 410 generally controls operation of the printing device 100 while the expected page delivery estimator 412 estimates the number of pages that can be printed by the printing device 100. In some embodiments, the expected page delivery estimator 412 generates the estimate with reference to the initial amount of each ink comprised by the printing device 100, the number of ink droplets of each ink that have been ejected by the printing device, and the weight of those droplets, as determined through measurement of light intensity using the sensing device 300. With further knowledge of the number of pages that have been printed, the expected page delivery estimator 412 can determine past ink usage per page to estimate how many more pages can be printed by the printing device 100 in view of a user's particular usage pattern. Alternatively, utilizing the average typical page ink droplet use, the estimator 412 can estimate of how many more average typical pages can be printed.

As indicated in FIG. 4, the expected page delivery estimator 412 comprises a drop weight determination module 414 that controls and communicates with the sensing device 300, and further determines the drop weights for each inkjet pen 200 of the printing device 100 using information collected by the sensing device. In particular, the drop weight determination module 414 collects signals from the sensing device 300 and determines the drop weight for each inkjet pen 200 relative to the amplitudes of those signals.

Various programs (i.e. logic) have been described herein. Those programs can be stored on any computer-readable medium for use by or in connection with any computer-related system or method. In the context of this document, a computer-readable medium is an electronic, magnetic, optical, or other physical device or means that contains or stores a computer program for use by or in connection with a computer-related system or method. Those programs can be embodied in any computer-readable medium for use by or in connection with an instruction execution system, apparatus, or device, such as a computer-based system, processor-containing system, or other system that can fetch the instructions from the instruction execution system, apparatus, or device and execute the instructions.

Example systems having been described above, operation of the systems will now be discussed. In the discussions that follow, flow diagrams are provided. Process steps or blocks in these flow diagrams may represent modules, segments, or portions of code that include one or more executable instructions for implementing specific logical functions or steps in the process. Although particular example process steps are described, alternative implementations are feasible. Moreover, steps may be executed out of order from that shown or discussed, including substantially concurrently or in reverse order, depending on the functionality involved.

Figure 5:
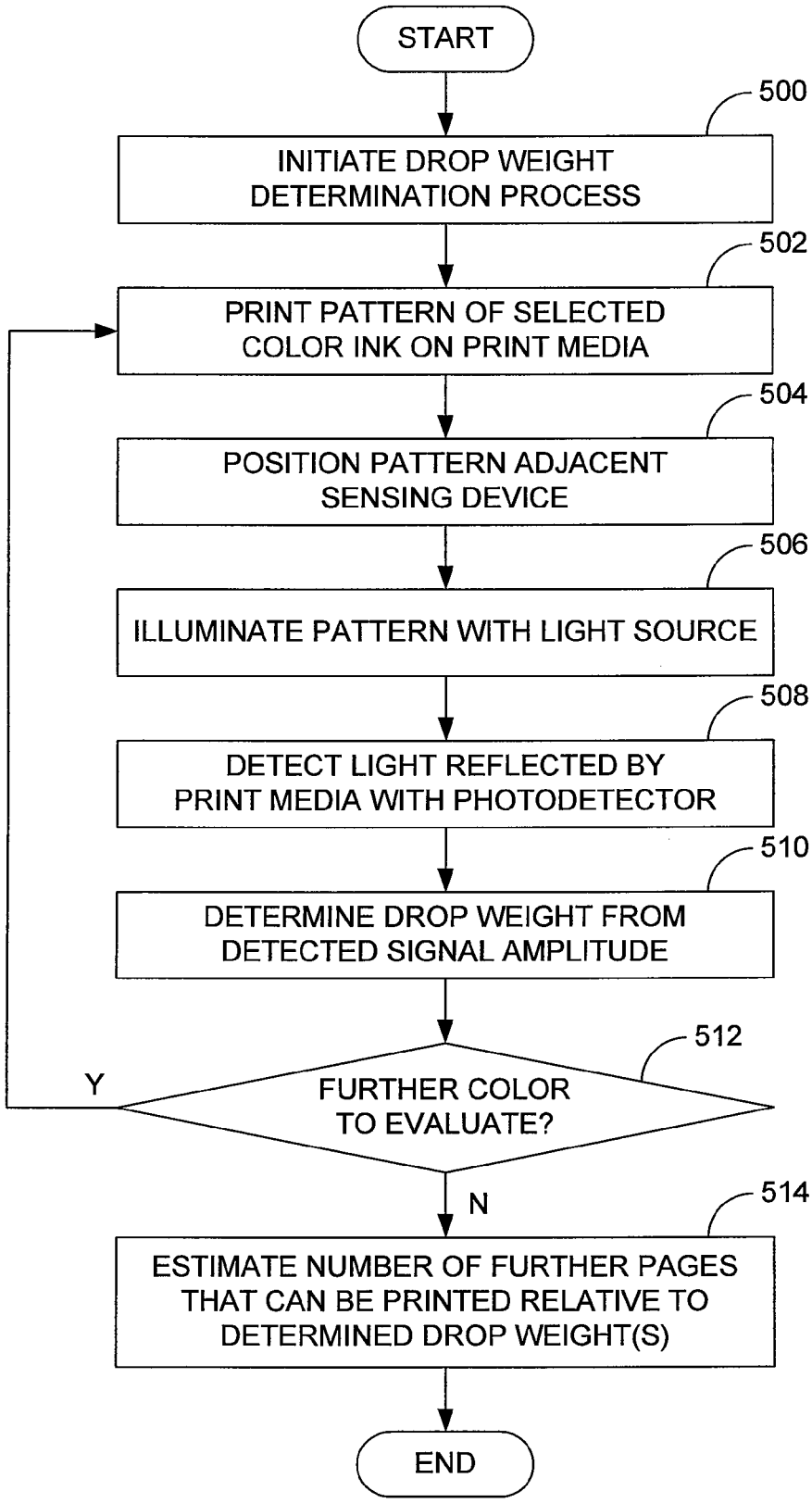
FIG. 5 is a flow diagram of an embodiment of a method for estimating the number of pages that can be printed by a printing device using a measured drop weight.

FIG. 5 illustrates an example method for estimating the number of pages that can be printed by a printing device using one or more drop weights measured by the printing device. Beginning with block 500, the drop weight determination process is initiated. In some embodiments, the drop weight determination process can be performed periodically as a device calibration process. In other embodiments, the drop weight determination process can also be performed when the printing device is commanded to perform that process by a user. Regardless, once the drop weight determination process is initiated, the printing device prints a pattern of a selected ink on print media, as indicated in block 502. By way of example, the pattern can comprise a rectangle or other shape having predetermined parameters. In some embodiments, the predetermined parameters include an intended number of drops that the printing device attempts to use to form the pattern. That number directly reflects or at least approximates, for typical printing, the number of droplets used to form the pattern, depending on whether or not all nozzles of the inkjet printhead are firing consistently. Nozzles can be prequalified to establish that all nozzles used to measure the drop weight are fully-functioning nozzles. More specifically, nozzles that are not firing drops due to clogging or other long-term defects are not used in the measurement of the drop weight. This duplicates normal, multi-pass printing in which malfunctioning nozzles are replaced by other fully-functional nozzles.

After the pattern has been printed, the printing device positions the pattern adjacent the sensing device, as indicated in block 504. Such placement is achieved by driving one or more motors of the print mechanism to adjust the position of the print media along the print path. Next, the pattern is illuminated by the sensing device light source, as indicated in block 506. Such illumination results in the absorption of light, for example, NIR light, by the ink and, more particularly, the marker dye it comprises. The light directed toward the print media and the printed pattern is reflected by the print media and is detected by the photodetector, as indicated in block 508. The light signal received by the photodetector has a particular amplitude that is representative of the amount of invisible light that has been absorbed by the pattern. Given that the amount of dye contained by the ink and the number of droplets used to form the pattern are known, the signal amplitude is indicative of the amount of ink that was printed and the drop weight of the droplets used to form the pattern. The amplitude is received by the drop weight determination module, which determines the drop weight, as indicted in block 510. The amount of light absorption material present in the printed pattern is determined. The drop weight for the inkjet pen used to form the printed pattern is determined from the amount of light absorption material determined to be present in the printed pattern. By correlating the signal amplitude to an amount of ink used to print the pattern, the drop weight may be calculated using the amount of ink and an approximation of a number of droplets used to form the printed pattern. Accordingly, through use of the sensing device, the actual drop weight for the given inkjet pen is determined.

At that point, the above-described process can be repeated for other inkjet pens of the printing device in cases in which the printing device is a multi-color printing device. Therefore, with reference to decision block 512, flow from this point depends upon whether there are further colors, and further inkjet pens, to evaluate. If so, flow can return to block 502. Notably, separate patterns for each of the colors of the printing device can be printed on the print media at or near the same time. Therefore, multiple patterns pertaining to separate colors and separate inkjet pens can be created before using the sensing device to determine the respective drop weights of multiple inkjet pens, if desired. Once all desired drop weights have been determined, flow continues to block 514 at which the determined drop weight(s) is/are used to estimate the number of further pages that can be printed.

It is noted that, in some embodiments, the accuracy of the sensing device 300 can be improved by calibrating its response. The reflectance of the print media can vary based upon its type. Also, in some embodiments, the sensing device's manufacturing tolerances may not be stored in the printer's nonvolatile memory. In these and other related situations, it can be convenient to calibrate the sensing device 300 before each measurement of the drop weight. In such a case, a primary calibration is used to measure and, in some embodiments, adjust the maximum signal strength from the sensing device 300. The maximum signal strength is achieved when the sensing device 300 is measuring a region of un-printed media. The maximum signal strength can be stored in either volatile or nonvolatile memory elements, based on the design goal for the printing device. The minimum signal can either be chosen to be zero or can be measured using a high absorption material. In some embodiments, it can be convenient to print a high droplet count density region using a carbon black pigment ink, which exhibits very high absorption in the illumination wavelength region of the sensing device 300. This measurement of the minimum signal can correct for any ambient light source that may add to the sensing device's response. The two response signals provide the calibration of the sensing device 300.

It is noted that, in some embodiments, normal, multi-pass printing may not replace the malfunctioning nozzles with other fully-functional nozzles. In such cases, non-firing nozzles can be included in the droplet count of the drop weight pattern. This accounts for the use of these non-firing nozzles of typical printing and more accurately identifies the average drop weight of typical printing. Thus, the average drop weight can provide a better estimate of the remaining pages that can be printed.

It is further noted that the sensing device described in the foregoing can be used to detect the boundaries of the print media in addition to determining drop weight. In such cases, the position and alignment of print media within the print path can be determined without requiring the provision of a separate optical sensing system.

What is claimed is:

1. A method comprising:

printing a pattern on print media using a printing device by depositing ink containing a light absorption material that absorbs invisible light;

determining the amount of light absorption material present in the printed pattern; and determining a drop weight for an inkjet pen of the printing device used to form the pattern from the determined amount of light absorption material.

2. The method of claim 1, wherein light absorption material comprises a dye that is invisible to humans.

3. The method of claim 1, wherein the light absorption material comprises a dye that absorbs infrared (IR) light.

4. The method of claim 1, wherein the light absorption material comprises a dye that absorbs near infrared (NIR) light.

5. The method of claim 1, wherein printing a pattern comprises printing the pattern using an intended number of droplets that approximates an actual number of droplets used to form the pattern.

6. The method of claim 1, wherein determining the amount of light absorption material comprises using a sensing device of the printing device, the sensing device comprising a light source that illuminates the print media and a photodetector that detects light reflected by the print media.

7. The method of claim 6, wherein determining the amount of light absorption material further comprises identifying an amplitude of a signal detected by the sensing device, the signal amplitude corresponding to the amount of light that is absorbed by the printed pattern.

8. The method of claim 7, wherein determining a drop weight comprises correlating the signal amplitude to an amount of ink used to print the pattern, wherein the drop weight can be calculated using the amount of ink and an approximation of a number of droplets used to form the printed pattern.

9. The method of claim 1, further comprising estimating a number of pages that the printing device can print using the determined drop weight.

10. A system comprising:

means for printing a pattern on print media using ink that contains a light absorption material that absorbs invisible light;

means for determining the amount of light absorption material present in the printed pattern; and means for determining a drop weight used to form the pattern from the determined amount of light absorption material.

11. The system of claim 10, wherein light absorption material comprises infrared (IR) absorbing dye.

12. The system of claim 10, wherein the means for printing comprise an inkjet pen of a printing device.

13. The system of claim 10, further comprising a sensing device of a printing device, the sensing device comprising a light source that emits invisible light and a photodetector that detects invisible light.

14. The system of claim 10, wherein the means for determining a drop weight comprise a drop weight determination module of a printing device that (i) correlates amplitude of a signal received from the means for sensing with an amount of dye in a printed pattern, (ii) correlates the amount of dye with an amount of ink used to form the printed pattern, and (iii) correlates the amount of ink with drop weight.

15. A printing device comprising:

an inkjet pen configured to eject droplets of ink that contain a light absorption material that absorbs infrared (IR) light, the inkjet pen further configured to print a pattern of ink having predetermined parameters on print media;

a sensing device configured to illuminate the print media on which the pattern is printed and measure an intensity of an IR signal reflected by the print media; and a drop weight determination module configured to determine an amount of light absorption material present in the printed pattern and a drop weight for the inkjet pen from the intensity measured by the sensing device.

16. The printing device of claim 15, wherein the drop weight determination module is further configured to determine an amount of ink used to form the printed pattern from the determined amount of light absorption material.

17. The printing device of claim 16, wherein the drop weight determination module is further configured to determine drop weight in view of the determined amount of ink and a number of droplets used to form the printed pattern.

18. The printing device of claim 15, further comprising an expected page delivery estimator configured to estimate a number of pages that the printing device can print using the determined drop weight.

* * * * *

UNITED STATES PATENT AND TRADEMARK OFFICE

CERTIFICATE OF CORRECTION

PATENT NO. : 7,645,015 B2
APPLICATION NO. : 11/735100
DATED : January 12, 2010
INVENTOR(S) : Charles H. McConica It is certified that error appears in the above-identified patent and that said Letters Patent is hereby corrected as shown below:

In column 6, line 29, in Claim 2, after "wherein" insert -- the --.

Signed and Sealed this

Third Day of August, 2010

David J. Kappos

David J. Kappos
*Director of the United States Patent and Trademark Office*